US012472998B2

(12) United States Patent
Danielsson

(10) Patent No.: US 12,472,998 B2
(45) Date of Patent: Nov. 18, 2025

(54) ENERGY DISSIPATION DEVICE

(71) Applicant: RXD—RESEARCH EXCHANGE DEVELOPMENT AB, Krylbo (SE)

(72) Inventor: Roger Danielsson, Krylbo (SE)

(73) Assignee: RXD—RESEARCH EXCHANGE DEVELOPMENT AB, Krylbo (SE)

( * ) Notice: Subject to any disclaimer, the term of this patent is extended or adjusted under 35 U.S.C. 154(b) by 491 days.

(21) Appl. No.: 18/028,411

(22) PCT Filed: Aug. 25, 2021

(86) PCT No.: PCT/SE2021/050824
§ 371 (c)(1),
(2) Date: Mar. 24, 2023

(87) PCT Pub. No.: WO2022/071839
PCT Pub. Date: Apr. 7, 2022

(65) Prior Publication Data

US 2023/0365168 A1 Nov. 16, 2023

(30) Foreign Application Priority Data

Sep. 30, 2020 (SE) ..... 2030300-4

(51) Int. Cl.
*B61G 11/16* (2006.01)
*B61G 7/10* (2006.01)
(Continued)

(52) U.S. Cl.
CPC ..... *B61G 11/16* (2013.01); *B61G 7/10* (2013.01); *B61G 9/04* (2013.01); *B61G 11/18* (2013.01)

(58) Field of Classification Search
CPC . B61G 7/10; B61G 9/04; B61G 11/16; B61G 11/18
See application file for complete search history.

(56) References Cited

U.S. PATENT DOCUMENTS

2008/0277366 A1 11/2008 Kemper
2009/0151595 A1 6/2009 Kontetzki
(Continued)

FOREIGN PATENT DOCUMENTS

CN 106672010 A * 5/2017 ..... B61G 11/16
CN 107200034 A * 9/2017 ..... B61G 11/16
(Continued)

OTHER PUBLICATIONS

RXD—Research Exchange Development AB, International Patent Application No. PCT/SE2021/050824, International Search Report, Oct. 21, 2021.
(Continued)

*Primary Examiner* — Robert J McCarry, Jr.
(74) *Attorney, Agent, or Firm* — Moore & Van Allen PLLC; W. Kevin Ransom

(57) ABSTRACT

An energy dissipation device is shown in connection with its implementation in train couplers. The energy dissipation device comprises axially compressible, irreversibly deforming steel elements arranged in a housing and axially pretensioned between a compression means and a counterpressure means. In case of an impact, the compression means is moving in sliding contact with the inside wall of the housing to provide axial compression of the energy absorbing elements while preserving the integrity of the housing.

20 Claims, 8 Drawing Sheets

(51) Int. Cl.
*B61G 9/04* (2006.01)
*B61G 11/18* (2006.01)

(56) References Cited

U.S. PATENT DOCUMENTS

| | | | | |
|---|---|---|---|---|
| 2013/0299441 | A1* | 11/2013 | Peckham | B61G 3/16 213/77 |
| 2017/0197641 | A1 | 7/2017 | Grahn et al. | |
| 2019/0077420 | A1* | 3/2019 | Debost | B61D 15/06 |
| 2019/0308645 | A1 | 10/2019 | Radewagen et al. | |

FOREIGN PATENT DOCUMENTS

| | | | | |
|---|---|---|---|---|
| CN | 110539773 | A | 12/2019 | |
| DE | 102016206989 | A1 * | 10/2017 | B61G 9/10 |
| DE | 102018103844 | A1 * | 8/2019 | B61G 11/16 |
| EP | 1854695 | A1 | 11/2007 | |
| EP | 2168838 | A1 | 3/2010 | |
| EP | 2845784 | A1 | 3/2015 | |
| EP | 3205551 | A1 | 8/2017 | |
| EP | 3059137 | B1 | 1/2020 | |
| EP | 3632767 | A1 * | 4/2020 | B61G 11/16 |
| GB | 2517970 | A * | 3/2015 | B61G 11/12 |
| GB | 2517986 | A * | 3/2015 | B61G 7/14 |
| WO | 2012143914 | A1 | 10/2012 | |

OTHER PUBLICATIONS

RXD—Research Exchange Development AB, International Patent Application No. PCT/SE2021/050824, Written Opinion, Oct. 21, 2021.

* cited by examiner

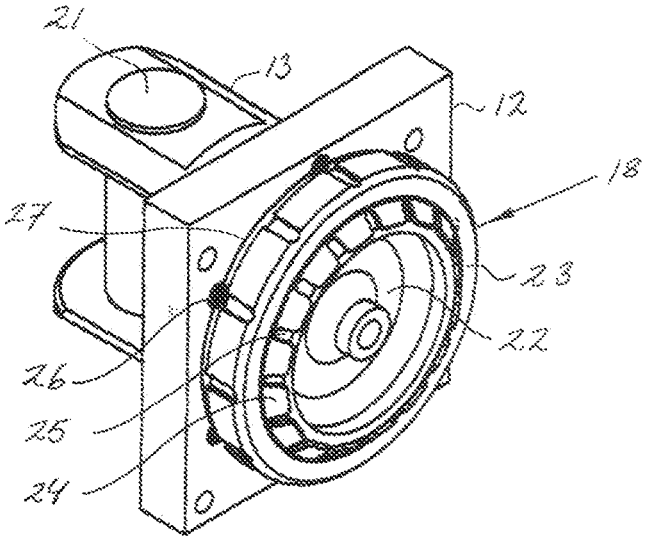
Fig. 4A
Fig. 4B
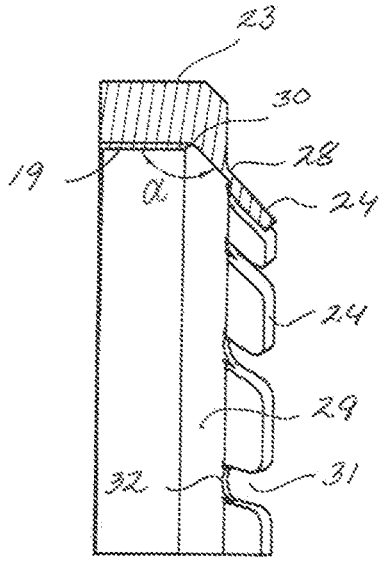
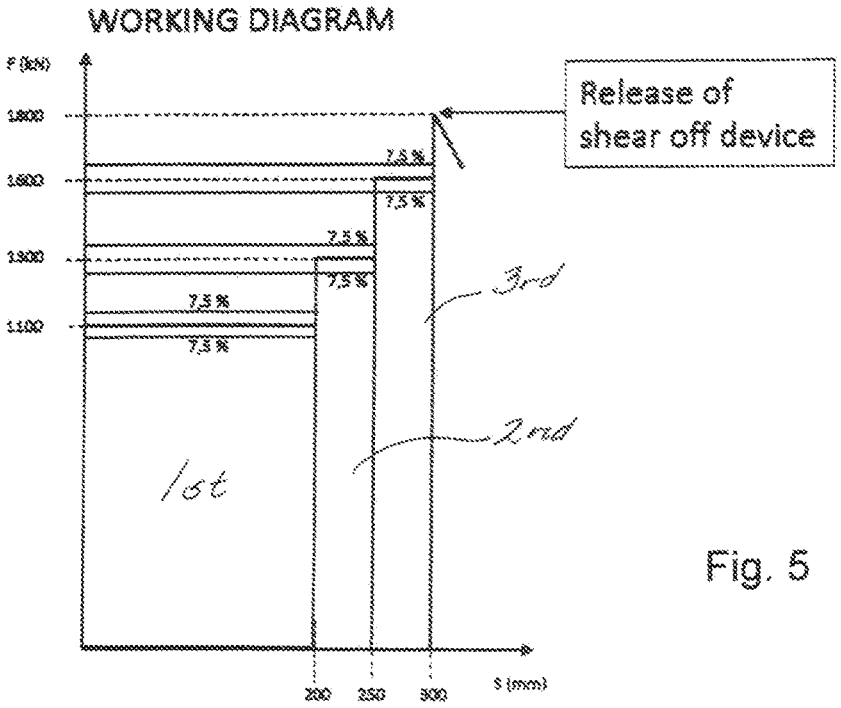
Fig. 5

ENERGY DISSIPATION DEVICE

CROSS REFERENCE TO RELATED APPLICATIONS

This application is a National Stage Patent Application (filed under 35 § U.S.C. 371) of PCT/SE2021/050824, filed Aug. 25, 2021, which, in turn claims priority to Swedish Patent Application No. 2030300-4 filed Sep. 30, 2020; the contents of each of which are hereby incorporated by reference.

FIELD OF THE INVENTION

The present invention relates to an energy dissipation device adapted for consumption of the energy of a force that is applied to the device in case of a crash. The invention also relates to implementations of the energy dissipation device in coupling interfaces between members of a vehicle train, as well as to the integration of the energy dissipating device in train couplers or side buffers. In an additional aspect, the invention relates to a shear-off assembly which forms a mating counterpart to one embodiment of the energy dissipation device.

BACKGROUND OF THE INVENTION

Energy dissipation or energy absorption devices are frequently applied as shock dampers at coupling interfaces between interconnected railway cars and in front-end couplers of motorized cars and locomotives. It is a challenge to designers of shock dampers in train couplers or side buffers to manage the shock wave that propagates through the train set in parts of a second, from the first to the last unit of the train, in case of collision.

Although numerous older solutions can be found in literature and practise, there is still room for improvements both with respect to energy absorption structures and management strategy for dissolving the energy that is released in collision.

The energy dissipation device of the present invention can be referred to the category of passive, non-regenerative shock dampers designed to consume the energy, rather than storing energy in metal springs, elastomeric bodies, or hydraulic and gas-hydraulic arrangements, etc.

In the subject category of energy dissipating devices, numerous examples in the prior art relies on energy consumption by radial deformation and expansion of an outer tube having an inner diameter, the expansion being induced by a plunger or mandrel of greater diameter which is forced through the tube by the dynamics of an impact. It is also known the alternative design, wherein the deformation tube is deformed radially inwards by a compressive force applied from an outer member that is run down the exterior of the deformation tube.

If to mention one prior art example of radially deforming shock dampers, reference can be made to EP3205551 A1. Said document is of interest also for disclosing a pivot bearing which can be sheared off from the car chassis to be retracted into a deformation tube which is arranged in the car chassis behind the pivot. A rear face of the pivot bearing is formed with an extended diameter that causes radial expansion of the deformation tube as the pivot bearing is sheared off and retracted into the deformation tube upon impact.

For an example of axially deforming shock absorbers, reference can be made to EP3059137 B1. This design for a front-end coupler comprises a package of honeycomb-structured deformation elements which are installed between a pivot bearing in a front end of the honeycomb structure and a shear-off member in a rear end of the honeycomb structure. A couple of guide bars, in front ends fixed to the car chassis via a support element and in rear ends carrying the shear-off member, extend in parallel through the honeycomb structures which are positively guided on the guide bars during compression in order to avoid warping. A housing which is attached to the car chassis, or forming an integer part thereof, takes no active part in guidance of the honeycomb structures during compression.

It is further known, per se, that a steel tube of continuous, multi-cornered sectional profile can be controlled to fold progressively and buckle in a uniform manner when subjected to a compressive force applied in axial direction of the tube. As far as the applicant knows, this technology has hitherto not been applied nor adapted for implementation in shock dampers for train couplers.

A previous attempt to control the shock wave that is transferred via coupling interfaces between units in a train set is disclosed in WO2012143914 A1. The document suggests that the compression strength of collapsible structures in shock dampers is varied and adapted in order to achieve a stiffness curve in compression, which has a downward concavity and which increases in a monotonic manner throughout the train. In order to achieve that, the first two coupling interfaces in the front end of the train should be designed to provide a lower energy absorption capacity, whereas the third coupling interface etc. is designed to absorb an amount of energy which is decidedly greater.

However, the development of crash forces through a train set in collision does not follow a monotonic and static scheme. On the contrary, halting the train to a stop is a dynamic process which involves a series of accelerations and retardations as each successive unit in the train crashes into the previous one. The series of internal impacts accumulate into a successively increasing load being transferred to train units and dampers that are closest to the point of collision. In respect of stroke length and energy absorption, the foremost dampers are typically fully exhausted in a crash. On the other hand, practise has also shown that the potential stroke lengths in dampers at intermediate interfaces of the train were only partially used as the train had come to a halt.

SUMMARY OF THE INVENTION

It is an overall object of the present invention to provide an energy dissipation device of alternative design.

One object of the present invention is to provide an energy dissipation device of lightweight design.

Another object of the present invention is to provide an energy dissipation device that requires few or less complicated machining operations during manufacture and assembly.

Still another object of the present invention is to provide an energy dissipation device which permits reuse of components that remain unaffected after dissipation of impact energy and which provides simplified exchange of exhausted deformation elements.

It is another object of the present invention to provide an energy dissipation device which can be integrated in front-end train couplers, in intermediate train couplers or in side buffers as well.

It is yet another object of the present invention to provide an energy dissipation device which is configured to be readily adapted for implementation at coupling interfaces between units of a train set in order to control the propagation of impact forces throughout a train of interconnected vehicles.

It is also an object of the present invention to provide an energy dissipation device that permits a higher degree of employment of the potential stroke length and resulting energy absorption by intermediate devices in a series of interconnected devices.

At least one of these or other objects/objectives will be satisfied in an energy dissipation device as defined in claim 1. Other objects/objectives will be met through the different embodiments and implementations of the energy dissipation device as set forth in additional claims.

In a first aspect of the invention, an energy dissipation device for a train coupler adapted for absorbing kinetic energy from a collision comprises a cylindrical housing, in one end having coupling means for coupling the housing in fixed relation to a train coupler. At least one axially compressible, irreversibly deforming element of steel is installed in the housing, and extended in coaxial relation with the housing from said one end towards a second end of the housing. A compression means is retractable into the housing via said one or said second end of the housing. The at least one compressible element is pre-tensioned axially between said retractable compression means and a counter pressure means stationary secured in the housing in opposite relation to the retractable compression means. The compression means has a circular periphery shaped for guidance in non-destructive sliding contact with the inside wall of the housing upon retraction and compression of the compressible element(s), while preserving the integrity of the housing.

The outlined solution ensures lightweight design through the use of steel in deforming elements which permit downsizing of wall thickness while maintaining compression strength and energy dissipation capacity.

The solution also permits reuse, on a case-to-case basis, of components such as the housing, the compression means and the counterpressure means.

In one embodiment of the energy dissipation device, said one end of the housing having coupling means arranged for coupling to a bracket for a pivot bearing which is retractable into the housing via said one end upon release from the bracket, and wherein a shear-off assembly, providing counter pressure in compression, is coupled to said second end of the housing.

This embodiment is adapted for integration in front-end couplers as well as intermediate couplers between cars, wherein coupler components are designed to be released to retract under the car chassis if subjected to an impact force above a specified shear-off magnitude.

It will be understood, that the stress acting on the housing in compression is restricted to axial tension, which provides the designer with freedom to maximize the length of the housing without adding undue mass weight to the housing.

More specifically, the shear-off assembly comprises a counter pressure disc of circular shape having a bevelled periphery bearing against the opposite faces of a number of yieldable tongues, the tongues depending individually at a slanting angle towards the center from an inner circumference of a flanged ring that is connectable in surrounding relation with the counter pressure disc.

One advantage and technical effect of this embodiment is that the housing can be preserved and intact after shear-off, since the shear-off assembly includes a replaceable component, i.e., the ring, which can be connectable to the housing by means of a threaded engagement.

In one embodiment, the energy dissipation device comprises a first telescoping member in the form of a tube of a first diameter, said tube in one end carrying coupling means for coupling the tube to a drawbar of a train coupler in coaxial alignment with the center axis of the drawbar. A second telescoping member has the form of a cylindrical housing of a second diameter which is larger than the first diameter, said housing in one end carrying coupling means for coupling the housing to a drawbar of a train coupler in coaxial alignment with the center axis of the drawbar. A second end of the tube is inserted and arranged retractable into the housing via an opposite second end of the housing. At least one compressible steel element in the housing extends in coaxial relation with the housing from said one end of the housing towards the second end of the housing. The compressible element is pre-tensioned axially between the coupling means in said one end of the housing and a neck portion extended axially into the housing from a mounting flange, coupled to said second end of the housing. The retracting end of the tube carries a compression disc which has a circular periphery shaped for guidance in non-destructive, sliding contact with the inside wall of the housing upon retraction and compression of the compressible element(s), while preserving the integrity of the housing.

The embodiment with telescoping tubes makes possible an integration of the energy dissipation device in the drawbar of a train coupler or in side buffers. In the drawbar, all parts of the integrated device are aligned in concentric relation about the center axis of the drawbar. The forces and kinetic energy that is transferred to the energy absorbing elements upon an impact is thus applied in the same direction as these elements are deforming while absorbing the energy. In other words, the nominal compression strength and resistance to deformation built into the design of the deforming elements can be fully utilized for energy absorption, without losses in efficiency and capacity caused by deflection of forces and counterforces.

The axial extension of the neck portion ends in a shoulder of radial extension providing support in axial direction for the compression disc which is carried in the retractable end of the tube.

The axial extension of the neck portion has an inner radius forming a circumferential control surface for the tube to move in sliding contact with the control surface upon retraction into the housing.

Embodiments of the invention may include an anti-rotation means in the form of a locking body shaped for form-fitting engagement in a correspondingly shaped seat which is formed in a flange of a member that is connectable to the housing. A heel on the locking body engages in locking position a recess that is formed circumferentially in the exterior of the housing.

In one embodiment, at least one intermediately positioned partition disc having a circular periphery is arranged in sliding contact with the inside wall of the housing, the partition disc axially clamped between a compressible element of a first compression strength and a compressible element of a second compression strength, and otherwise movable in the housing.

This embodiment provides a solution according to which energy dissipation units can be individually "tuned" for an adaptive and demand-driven (adjustable) force/stroke characteristics, which makes it possible to control the energy released (net contacting force) during longer impact time at each interface, such as for about 0.05 s to 0.1 s, by extending compression stroke minimum up to about 40-50%, this way reducing forces and avoiding peak forces.

Another technical effect provided by this embodiment is that the energy dissipation device can be designed, by corresponding choice of length and/or stiffness in the compressible elements, for portional deformation in response to different magnitudes of impact.

An advantage provided by this embodiment is that after an impact of limited magnitude, only the softer and collapsed elements need to be replaced whereas the stiffer elements can be reused. In other words, to simplify overhaul and repair, the elements of lower compression strength which are first to collapse upon impact can be installed directly behind a shear-off assembly, which can be dismounted by unscrewing from the housing.

In one embodiment, the partition disc comprises a flange in its periphery that forms an inner cylinder or lining in the housing, the axial length of the lining adapted to ensure movement without tilting in the housing. The lining is preferably not longer than the remaining axial length of the deformed element(s) after maximum compression.

Although a tendency for tilting of partition discs moving in the housing is effectively prevented in effect of the supporting contact with the compressible elements, this embodiment avoids even further the risk of jamming.

In a preferred embodiment, the compressible element is a tube made of roll-formed steel sections, fused-together to form a multi-cornered cross-sectional profile wherein the tube wall, in circumferential direction, is a repeating pattern of angularly adjoining side planes connected in at least twelve outwardly protruding corners and at least eight inwardly protruding corners.

In one embodiment, at least one axially compressible non-biased element is arranged in the housing, the non-biased element(s) extended in parallel with at least one energy absorbing element that is axially pre-tensioned in the housing between a compression means and a counter pressure means arranged respectively in opposite first and second ends of the housing, wherein the non-biased element(s) are of shorter length(s) than the pre-tensioned element.

An advantage and technical effect provided from the auxiliary, non-biased element(s) is a gradual absorption of peak load from impact, similar to a concertina effect in compression.

Another advantage and technical effect is that a comparatively high and continuous and flat level of energy absorption can be maintained throughout the energy dissipation process. This is due to a phase shift and mutual displacement of the buckling behaviour during the compression sequence that is provided by compressible elements of stepwise decreasing lengths.

Energy dissipation devices according to the invention can be arranged in series and configured for integration at coupling interfaces between interconnected units of a train.

Advantageously, in a series of energy dissipation devices arranged for integration at coupling interfaces between interconnected cars and motor cars or locomotives of a train, wherein for individual devices of the series, stroke length and/or compression strength is predetermined with regard to the positions of the individual devices in the series, and with the object of minimizing peak loads absorbed in intermediate devices.

In coupling interfaces between train units, at least one energy dissipation device has a primary deformation zone of less compression strength than the compression strengths provided by successive deformation zones of the same device.

The distribution and relative absorption of kinetic energy among the devices in the series can be graphically represented by a levelling curve which has a slope in the range of 2-5 percent from the second to the fifth coupling interface of a six-unit train.

At least the foremost devices in the series may be configured to provide a higher peak compression strength than any intermediate device in the series. Devices in each fore and aft region of the series can be configured to provide a gradual increase of peak compression strength towards the foremost and rearmost devices in the series.

At least the foremost device in the series can be configured to provide a primary deformation zone of less peak compression strength than the peak compression strengths provided by a secondary and a third deformation zone of the same device.

In other words, the energy dissipation devices in the end regions of the series and train set can be made stiffer with respect to their dampening characteristics, than the successive or previous devices in the series, respectively.

Accordingly, while being designed or charged with a capacity to withstand high levels of energy, relatively speaking, the foremost and rearmost devices in the series may still preferably be configured to provide a stepwise increasing capacity. More precisely, the energy dissipation device which is first to be subjected to the energy released upon impact is advantageously designed with a first deformation zone of less compression strength than the compression strengths provided by a second, a third or a fourth deformation zone, e.g., of the same device.

It is contemplated that this gradual introduction of impact energy in the series of interacting devices, which can all be individually pre-tensioned in assembly, results in further biasing of the whole series of devices for an instant reaction, throughout the series, to the higher energy levels which are introduced as the second, third or fourth deformation zones of the first device become involved in the energy dissipation process. A technical effect is that the entire series of energy dissipation devices is triggered within milliseconds for dissipation of large amounts of energy when the shock wave reaches the last unit of the train. In result, kinetic energy is distributed throughout the train such that damage to car bodies and underframes can be reduced throughout the train set.

Further details, advantages and technical effects of the invention will appear from the detailed description provided with references to the accompanying, schematic drawings.

BRIEF DESCRIPTION OF THE DRAWINGS

In the drawings,

FIG. 4A shows an alternative application of a shear-off assembly that forms a mating counterpart to the energy dissipation device of the invention, FIG. 4B is a cut-out portion of a member in the shear-off assembly of FIG. 4A, FIG. 5 is a working diagram showing the operation characteristics of one embodiment of the energy dissipation device.

DETAILED DESCRIPTION OF PREFERRED EMBODIMENTS

Figure 1:
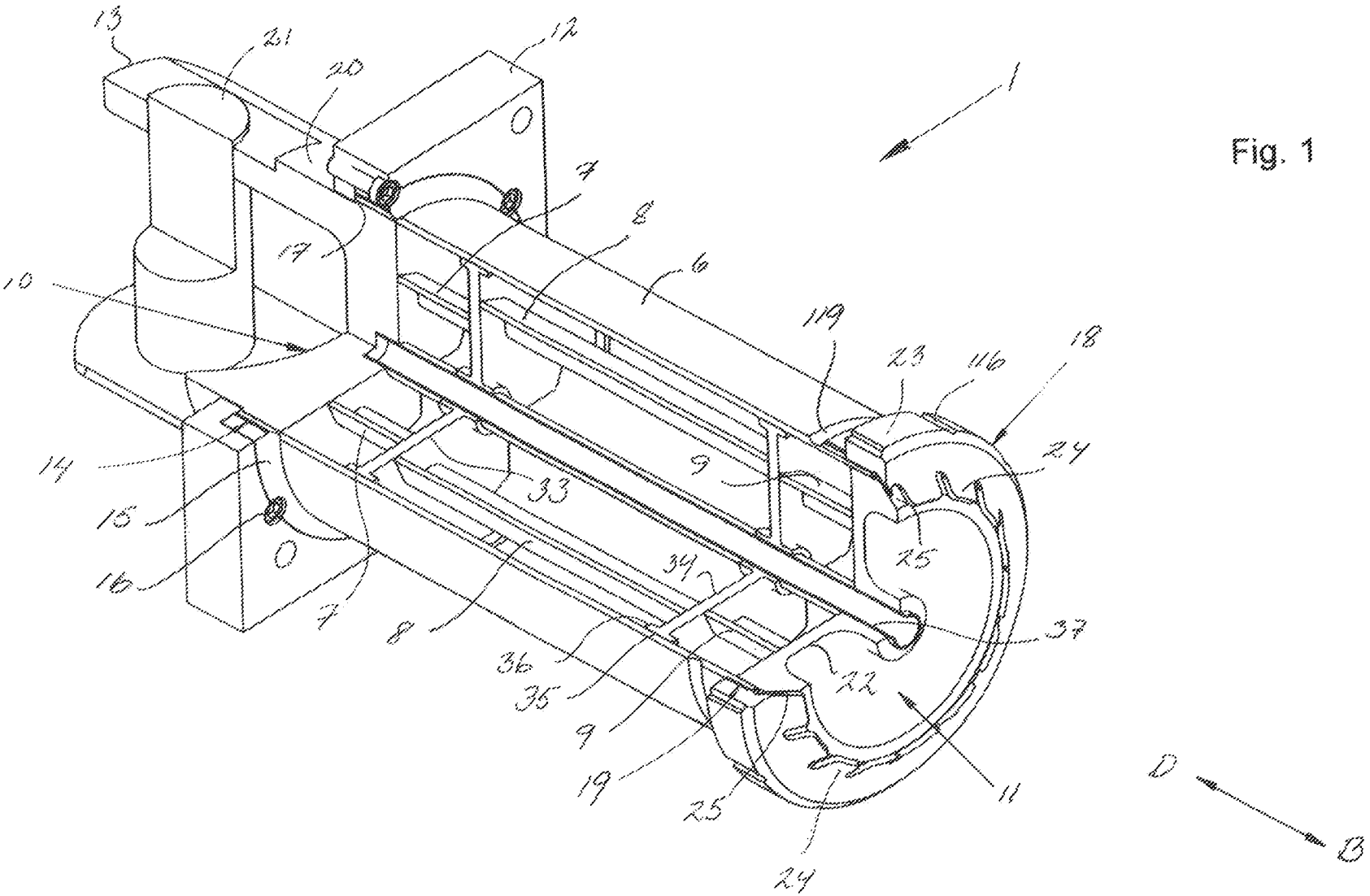
FIG. 1 is a partially sectioned view showing the energy dissipation device in one embodiment adapted for implementation in a train coupler.
Figure 6:
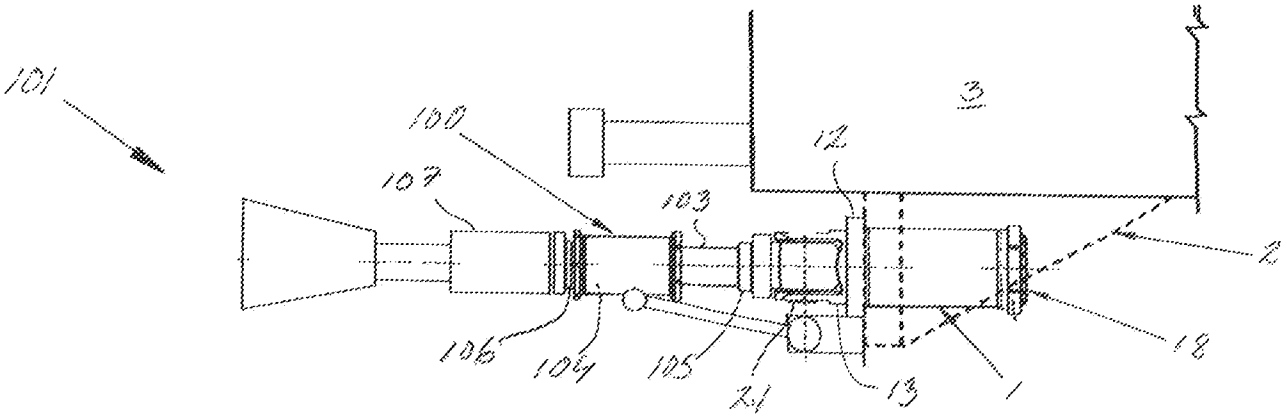
FIG. 6 illustrates implementation of the energy dissipation device in a front-end train coupler or automatic train coupler.
Figure 7:
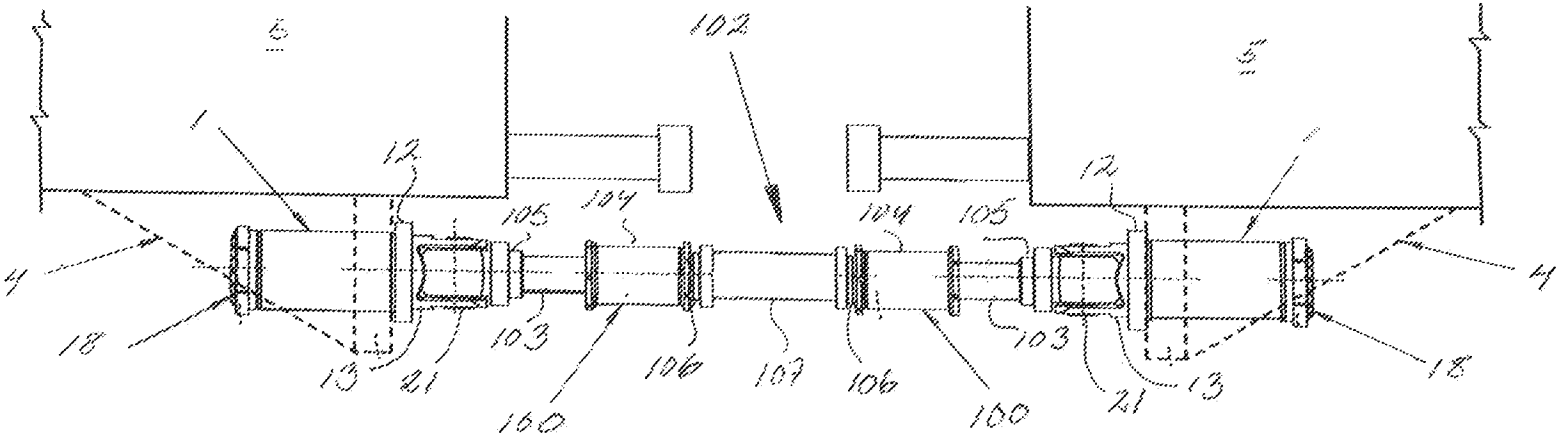
FIG. 7 illustrates implementation of the energy dissipation device in an intermediate train coupler.

With reference to FIGS. 1, 6 and 7, an energy dissipation device 1 of a first embodiment is adapted for mounting in the underframe 2 of a motor car or locomotive 3 (FIG. 6) or in the underframe 4 of a trailing car 5 (FIG. 7). The energy dissipation device 1 comprises a housing 6 wherein axially compressible steel elements 7, 8 and 9 are installed and pre-tensioned axially between a compression means 10 and a counter pressure means 11. One end of the housing 6 is stationary coupled to a structural component of the underframe, such as coupled in threaded engagement with a bracket 12 for a pivot bearing 13. The engaging threads at 14 may be formed on an outer radius of the housing and on an inner radius of a locking ring 15, respectively. The locking ring 15 is bolted to the bearing bracket 12 by means of bolts 16.

The compression means 10 in said one end of the housing is realized in the form of the pivot bearing 13. The pivot bearing 13 is operatively connected to the bearing bracket 12, such as via radial shoulders 17, for transfer of traction to a trailed unit in the draft direction D. Compressive forces in the buff direction B is transferred via the deforming elements 7-9 to a shear-off assembly 18 which is coupled to an opposite second end of the housing 6 via a threaded engagement 19. The shear-off assembly 18 will be explained in more detail below.

The housing 6 is a cylinder, the inner diameter of which is adapted to the outer diameter and cylindrical exterior 20 of the pivot-bearing 13. In case of an impact of sufficient magnitude being applied to the pivot bearing in the direction of B, the pivot bearing 13 and pivot pin 21 will relocate from the bearing bracket 12 and slide through the interior of the housing 6, axially compressing at least one or some of the elements 7-9 which will be irreversible deformed in the process.

In the housing 6, the compressible elements 7, 8 or 9 are maintained under axial pre-tension and bias. This pre-tension is provided from the compression means 10/pivot bearing 13 on one hand, and on the other hand from a counter pressure disc 22 being an operative component of the shear-off assembly 18. More precisely, pre-tension is created in assembly by applying the force from a jack to the package of compressible elements upon securing them in the housing. The pre-tension is maintained by means of a release structure in the form of a flanged ring 23 with yielding elements 24, wherein a thread on the inner radius of the ring (see at 19) engages a thread on the outer radius of the housing 6.

The yielding elements 24 are realized as fingers or tongues 24, which are distributed circumferentially about an inner circumference of the ring 23. The tongues 24 extend rearwards from said inner circumference, at a slanting angle towards an axial center of the ring. A circular, outwardly bevelled periphery 25 on the counter pressure disc 22 forms a conical rear face 25 which bears against the opposite faces of the tongues 24. Upon release, the tongues will yield from the pressure by bending or breaking to let the counter pressure disc 22 pass through the ring 23.

In this connection reference can be made to FIG. 4A which illustrates the shear-off assembly 18 in alternative mounting behind the pivot bearing, bolted directly to a bearing bracket 12 by means of bolts 26 and a locking ring 27, onto which the flanged ring 23 can be secured in threaded engagement.

FIG. 4B illustrates a cut-out portion of the flanged ring 23 in the shear-off assembly 18. Via a thinned-out portion 28, the yieldable tongue 24 adjoins an inwardly bevelled and conical face 29 that runs circumferentially on the inner periphery of the flanged ring 23. The conical face 29 adjoins the threaded cylindrical inner face 19 at an angle $\alpha$ of about 135°. The transition from the conical face 29 to the threaded face 19 is made with a radius at 30 in order to avoid fracture indications at the transition region. For a similar reason, the gaps 31 between adjacent tongues 24 are formed with a radius 32 at the tongue base and connection to the conical face 29.

In the embodiment of FIG. 1, the housing 6 accommodates a pair of partition discs 33 and 34. The partition discs 33, 34 divide the housing 6 in three separate deformation zones, in FIG. 5 named $1^{st}$, $2^{nd}$ and $3^{rd}$ deformation zones, each of which contains at least one compressible element 7, 8 or 9 under axial pre-tension.

The first, second and third deformation zones may be equipped and "charged" with compressible elements of different compression strengths and deformation resistance. It will be realized, that regardless of the internal order among the elements of different compression strengths, the deformation zone which contains the least resistant element/elements will be first to collapse in case of a crash. For this reason, advantageously, the rearmost zone of the housing can be equipped with the less resistant elements in order this way to reduce time and labor for repair and replacement of compressible elements in case of a minor impact.

The significance of a progressively increasing deformation resistance will be more discussed below.

In this context, reference is made to FIG. 5 of the drawings. FIG. 5 illustrates the damping characteristics of a three-zoned energy dissipating device wherein the first deformation zone $1^{st}$ is equipped to yield under an impact force of 1100 kN, a second zone $2^{nd}$ is yielding under a force of 1300 kN, and a third zone 31*d* resists up to 1600 kN before yielding. Finally, the shear-off assembly releases at an impact force of 1800 kN. In the example illustrated in FIG. 5, the total length of compression is 300 mm before shear-off.

It must be realized that FIG. 5 illustrates a non-limiting example only.

Of course, the invention can be realized in other embodiments comprising one or more deformation zones separated by partition discs and equipped with deforming elements of different peak compression strengths. The design with freely moving or "floating" partition discs as separators between deformation zones provides unlimited freedom to equip and "tune" each device with regard to its position in a train set. In other words, the number and lengths of deformation zones, as well as length, sectional profile, wall thickness and steel grade of deforming elements, are adjustable parameters which can be used by an engineer to customize each device with respect to its position in the train, while paying attention to the total number of cars, individual car weights, accumulated weight of the train set, stability in underframes or car bodies, train's running speed etc. These parameters can be defined mathematically and used in software simulators when computing specifications for each device in a series of interacting energy dissipation devices, upon implementation of the impact management strategy as taught by the present invention.

The compression means 10 at least, and also the partition discs of multi-zoned embodiments, are dimensioned and configured to move under non-destructive sliding contact with the inside surface of the housing 6. In this context, the axial length of the continuous radius section 20 of the pivot bearing 13 is deemed enough to ensure non-tilting and a jam-free movement in the housing.

In order to ensure a jam-free motion in the housing for partition discs, the circular peripheries 35 of the partition discs 33, 34 may be shaped with an axial extension or flange 36 which counteracts tilting and supports the partition disc so as to maintain a transverse orientation throughout its movement in the housing. The axial length of this flange should not, preferably, exceed the remaining axial length of the corresponding compressible element after its full compression.

In this connection it can be mentioned, that "full compression" will usually leave the deformed element with a remaining rest length in the order of about 20%.

In addition to constructive matters, a lubricant may be applied to the inner surface of the housing, if appropriate.

In the embodiment of FIG. 1, a stroke length indicator rod 37 extends through the energy dissipation device 1 from its attachment in the rear face of the pivot bearing 13. The indicator rod 37 reaches through a hole in the center of the counter pressure disc 22 in the opposite second end of the housing, and extends likewise through all partition discs of multi-zone embodiments. The indicator rod 37 provides an indication of the axial length of compression and the amount of deformation of the compressible elements. Registration may involve optical or electrical registering means, which can be read from a driver's cabin or by computer on car or by remote computer outside the train.

Figure 2:
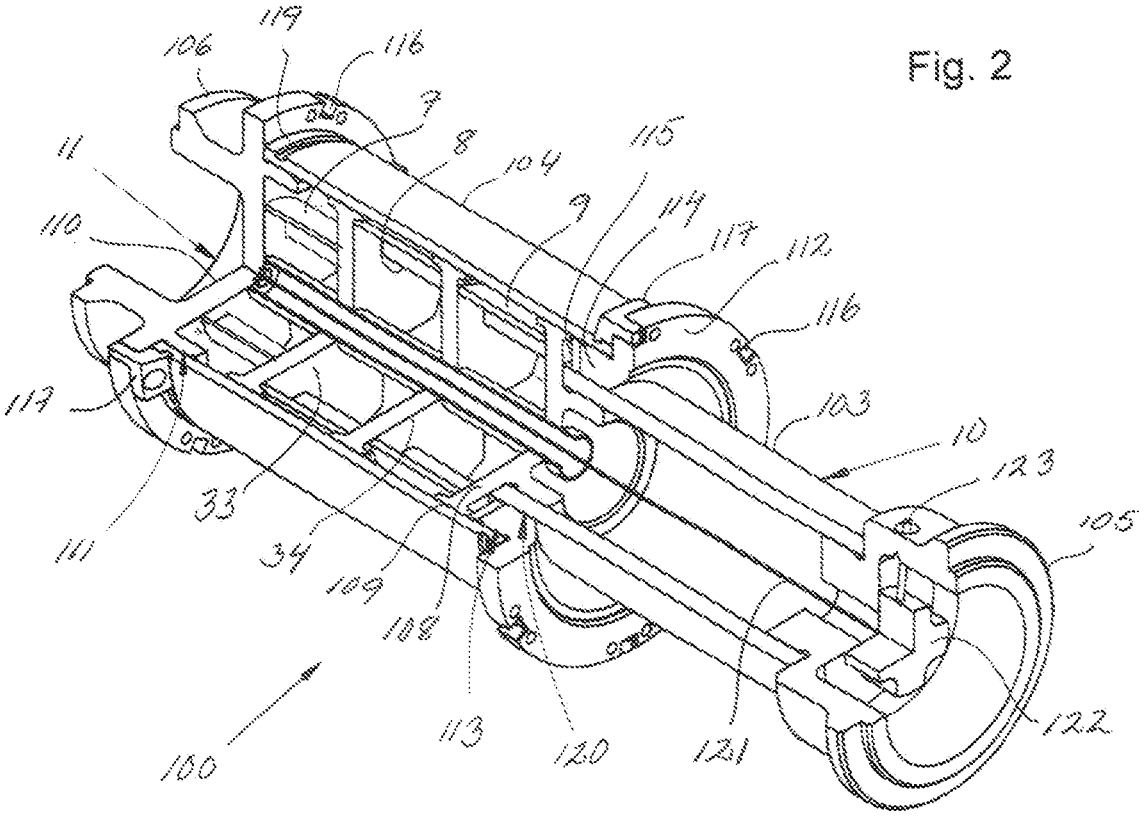
FIG. 2 is a partially sectioned view showing an alternative embodiment of the energy dissipation device adapted for implementation in a train coupler.

Next, an alternative embodiment 100 of the energy dissipation device will be described with reference to FIGS. 2, 6 and 7. To the extent that the embodiments 1 and 100 share the same components or components of equal function with respect to the operation of the component, these components will be equally numbered in the descriptions of the two embodiments.

The energy dissipation device 100 is adapted for integration in a drawbar of a front-end train coupler 101 (FIG. 6) or in the drawbar of an intermediate train coupler 102 (FIG. 7). The energy dissipation device 100 is a telescopic structure comprising a first or inner tube 103 of a smaller diameter which is retractable into a second and outer tube 104 of larger diameter. Each tube carries in one of its ends a coupling flange 105 and a coupling flange 106 respectively. The coupling flange 105 in said one end of the inner tube 103 is adapted for connecting the device 100 in coaxial alignment with a pivot pin bearing 13, whereas the coupling flange 106 in said one end of the outer tube 104 is adapted for connecting the device 100 in coaxial alignment with a drawbar section 107.

The outer tube 104 constitutes a housing 104 in which compressible steel elements 7, 8 or 9 are pre-tensioned axially between, on one hand, a compression means 10 here realized in the form of a compression disc 108, having a circular periphery 109 and supported in the retractable end of the inner tube 103, and on the other hand a counterpressure means 11 here realized in the form of a wall member 110 integrated in the coupling flange 106. Partition discs 33, 34 may be installed for separation of deformation zones in the housing 104, as previously explained with reference to the embodiment 1.

Pre-tension of the energy dissipation device 100 is accomplished on assembly. More precisely, an axial load can be applied from a jack that is acting on the compression means 10 to press the compressible elements in the housing 104 towards the counter pressure means 11 and coupling flange 106, the latter fixedly attached to said one end of the housing in a threaded engagement at 111. While under pressure from the jack, a mounting flange 112 is coupled to the housing 104 by means of engagement at 113 between a thread formed on an inner radius of the housing and a thread formed on an outer radius of a neck portion 114, the neck portion 114 forming an integral part of the mounting flange 112. The neck portion 114 on the flange 112 projects axially into the housing and presents a shoulder 115 of radial extension which abuts the compression disc 108 so as to maintain the device under pre-tension also when the jack is removed.

Figure 3:
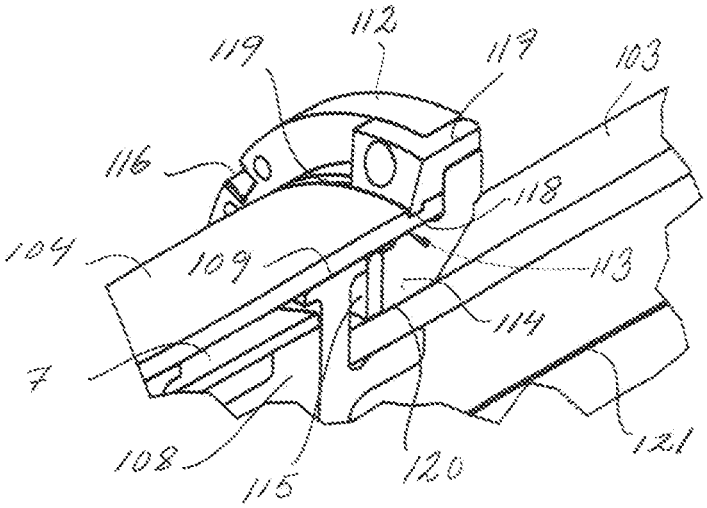
FIG. 3 is a cut out view on larger scale showing a structural detail of the energy dissipation device.

Next, reference is made also to FIG. 3 of the drawings. Recesses 116 formed in the region of the peripheral edge of the mounting flange 112 provide seats 116 for locking bodies 117 which can be bolted to the mounting flange in a form-fitting engagement. Each locking body 117 has a heel 118 that engages a recess 119 which runs circumferentially about the exterior of the housing 104. The locking bodies 117 fixate the mounting flange 112 and housing 104 in relative position and prevent rotation between them. In similar way, locking bodies 117 may be applied to prevent relative rotation between the housing 104 and the coupling flange 106. The same anti-rotation arrangement can be applied to the coupling flange 106 in said one and first end of the housing 104.

Although not being shown in FIG. 1 for clarity reasons, it should be pointed out that the anti-rotation arrangement of reference numbers 116 to 119 can be applied also to the embodiment 1 of FIG. 1 (see, e.g., the recess 119 formed in the exterior of the housing 6 and the seats 116 formed in the peripheral edge of the flanged ring 23).

In compression of the energy dissipation device 100 upon impact, the inner tube 103 operates like a plunger that moves in sliding contact with a cylindrical control surface 120, formed on the axial extension and inner radius of the neck portion 114. In compression, the inner tube 103 pushes the compression disc 108 through the housing in non-destructive sliding contact with the inner wall of the housing. The same applies to the partition discs 33, 34 etc., in sectioned or multi-zoned embodiments. The same measures as previously described can be applied to prevent movable discs from tilting and jamming in the housing 104.

A stroke length indicator-wire 121 extends through the energy dissipation device 100 from its attachment at an inner face of the coupling flange 106. The indicator-wire 121 reaches through a hole in the center of all movable compression discs in the housing 104 to a counter means 122 supported on the coupling flange 105. In a way known per se, the counter means 122 can comprise a spring-biased wheel (not shown in the drawing) onto which the wire is wound up when the energy dissipation device is compressed. A reader 123 counts the revolutions of the wheel which is related to the wound-up length of the wire. The counts can be visually observed at the reader, or reported by wire to an on-board computer for display in a driver's cabin, e.g.

Each embodiment 1 and 100 of the energy dissipation device relies on tube lengths of steel to absorb and consume the energy in case of collision. As used herein, the expression steel shall be understood to include, but is not limited to, steel grades which are commonly referred to in the trade as steel, high-strength steel (HSS), advanced high-strength steel (AHSS), ultra-high-strength steel (UHSS), as well as stainless steel.

The steel tubes, forming the compressible elements 7-9, are preferably realized as continuous profiles of multi-cornered cross section. Beside four-sided rectangular profiles, the wall of the compressible element may consist of a repeating pattern of angularly adjoining side planes, providing corners some of which are outwardly protruding and some of which are inwardly protruding.

As a rule of thumb, more corners and side planes included in the profile will result in higher compression strength and resistance to axial compression and buckling. On the other hand, the more complicated a profile is the more complex it will be to ensure a uniform buckling and deformation when the profile is compressed axially. Therefore, it serves no purpose to provide general rules in this respect, and it remains a task for the skilled person or engineer to combine steel grade, sectional profile, tube diameter and length as well as wall thickness in order to achieve a desired compression strength and resistance to buckling.

It is also known in the art that folding triggers such as indentations, holes or recesses can be formed in the tube wall in order to achieve a desired buckling pattern and behaviour. By proper application of folding triggers, the designer can avoid a chanceful dependency on material properties and instead control the buckling behaviour. It is possible this way to limit a variation in compression resistance during axial compression to stay within a range of about +/−7.5% (see FIG. 5).

Figure 8A:
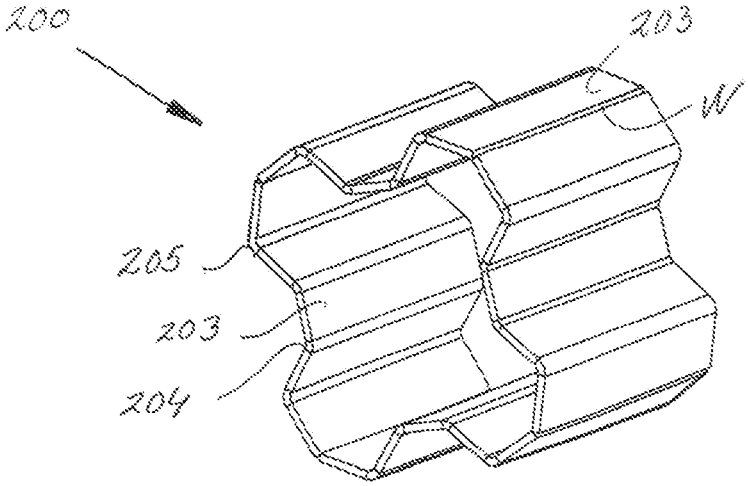
FIGS. 8A, 8B and 8C show examples on sectional profiles of energy absorbing elements suitable for implementation in the energy dissipating device.
Figure 8B:
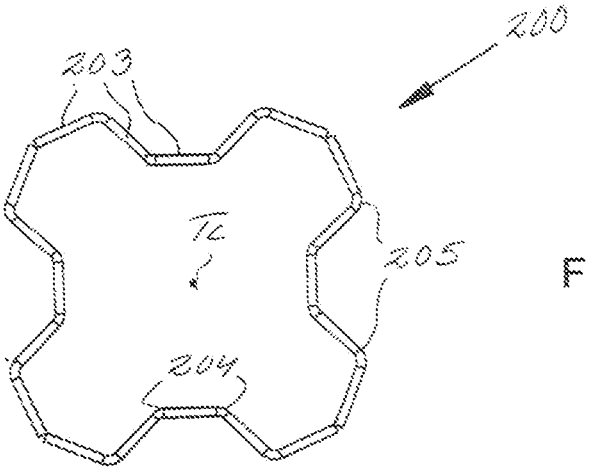
Figure 8C:
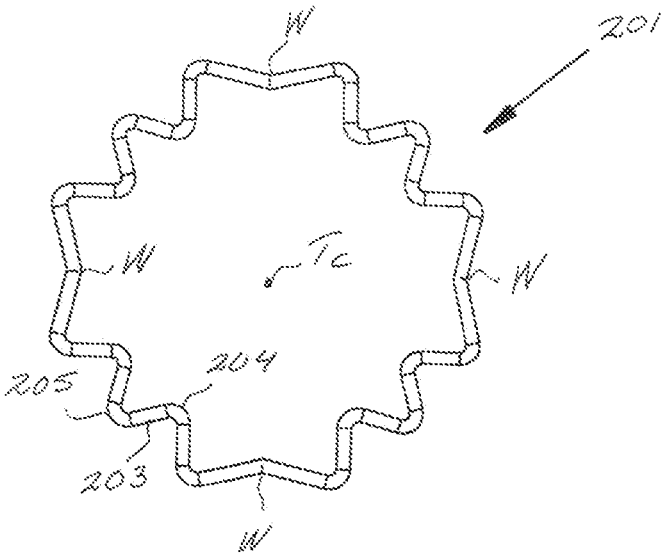
Figure 10:
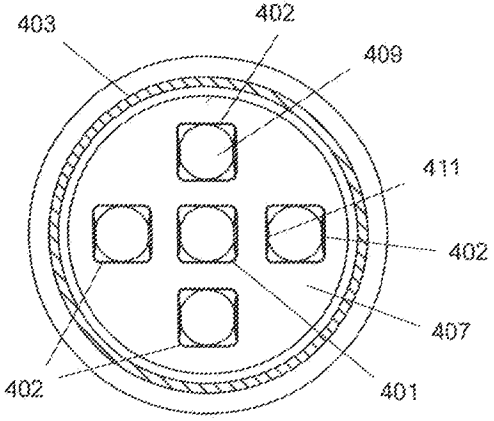
FIG. 10 is a cross-sectional view of the embodiment of FIG. 9 along the sectional plane X-X.

For illustration, FIGS. 8A, 8B and 8C show a couple of non-limiting examples of profiles 200 and 201 suitable for implementation as energy absorbing elements in the energy dissipation device. Each embodiment is composed of roll-formed sections which are welded together at longitudinal welding seams. In particular, a compressible element may comprise one singular section which is folded such that longitudinal edges meet to be fused together in one longitudinal welding seam W. Other embodiments may include two or more sections which are combined in a symmetrical arrangement about a tube center Tc and fused together at welding seems W. The profile 200 contains twelve outwardly projecting corners 205 and eight inwardly projecting corners 204 interconnected by side planes 203, whereas the profile 201 contains twelve outwardly projecting corners 205 and twelve inwardly projecting corners 204 interconnected by side planes 203.

On assembly, steel tubes such as the profiles 200 or 201 are typically individually installed with the tube center Tc coinciding with the longitudinal center axis of device housing 6 or 104. If appropriate, several tubes may be jointly installed and concentrically arranged with coinciding tube centers Tc (not shown). Several tubes may alternatively be arranged in symmetric distribution about the center axis of the housing, in such case equally angularly spaced and with their tube centers Tc on equal radial distance from the housing's center axis (also not shown).

An alternative embodiment 400 of the energy dissipation device is illustrated in FIGS. 9 to 13. In this embodiment of an energy dissipation device 400, a set of axially compressible, elements 401 and 402 are arranged in a housing 403. The housing 403 is in a first or one end coupled to a pivot bearing bracket 404, such as by means of a coupling ring 405. At least one compressible element 401 is axially pretensioned between a pivot bearing 406, forming a compression means 406 with a circular outer periphery that is axially movable in the housing 403 upon impact and release, and a counter pressure disc 407 forming part of a shear-off device 408 that is connected to the housing 403 in a second end of the housing 403, in axially opposite relation to the pivot bearing 406 received in the first end of the housing.

Figure 9:
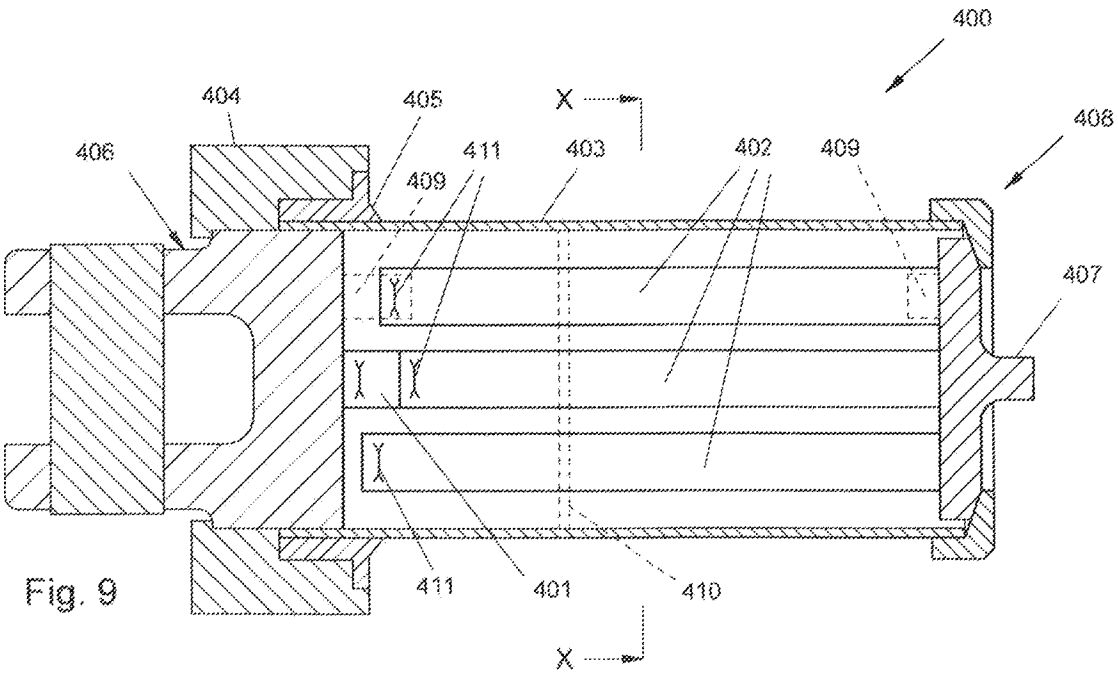
FIG. 9 is an axial section view through an alternative embodiment of the energy dissipation device of the present invention.

The compressible elements 402 extend substantially in parallel with the at least one pre-tensioned compressible element 401. The compressible elements 402 are in one end respectively secured to either one of the pivot bearing 406 or the counter pressure disc 407. The compressible elements 402 may be secured to the pivot bearing 406 or to the counter pressure disc 407 by welding. The compressible elements 402 may extend cantilevered from their anchored ends. However, mounting studs 409 may advantageously be arranged on the pivot bearing 406 and/or on the counter pressure disc 407 for positioning of the compressible elements 402 without the need for fixation. Spacers 410 may alternatively be arranged for holding the compressible elements 402 in fixed parallel positions. In FIG. 9, three compressible elements 402 are visible whereas a fourth element is hidden on the far side of the pre-tensioned element 401.

In a set of compressible elements, individual elements 402 may be equally angularly spaced about a central, pre-tensioned element 401. In other embodiments, compressible elements 402 may be arranged inside the wall of a surrounding pre-tensioned compressible element (not shown in the drawings).

The compressible elements 402 are not pre-tensioned in assembly. More precisely, the compressible elements 402 are cut to shorter lengths than the pre-tensioned element(s) 401. In order to avoid confusion, the compressible elements 402 of shorter lengths will hereinafter be referred to as non-biased elements 402 this way reflecting the fact that they are not set in pre-tension upon assembly of the energy dissipation device 400.

In one embodiment, a first non-biased element 402 is shorter in length by a few mm as compared to a pre-tensioned element 401. Each additional non-biased element 402 is a few mm shorter in length than the previous one, such that upon impact and compression of the energy dissipation device, an additional energy absorbing element will be employed for each travel of a few mm in length of compression.

In other words, the energy dissipation device of the embodiment 400 provides absorption of impact load in what can be referred to as a concertina effect: instead of an instant rise to the peak load, the maximum effect is reached incrementally through a number of compressible elements 401, 402 which are successively activated in the energy absorption process. FIG. 12 is a series of snapshots that illustrate, schematically, the mutually displaced buckling of compressible elements during the process, from impact in FIG. 12*a* to shear-off in FIG. 12*f*.

Figure 13:
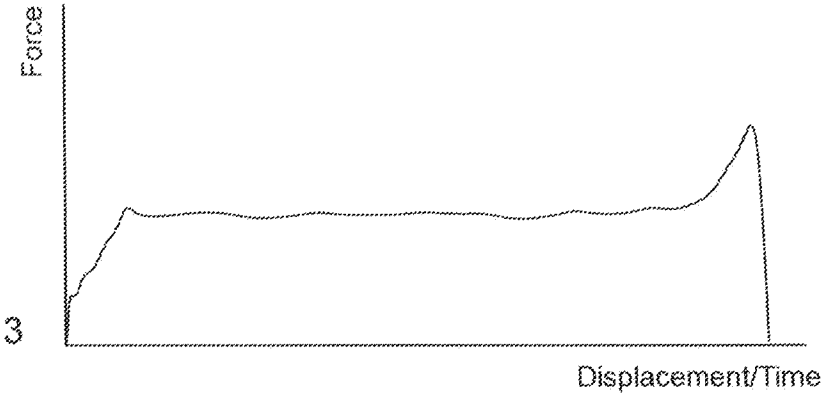
FIG. 13 is a force vs displacement/time diagram showing the operational characteristics of the energy dissipation device of FIGS. 9 to 12.
Figure 11:
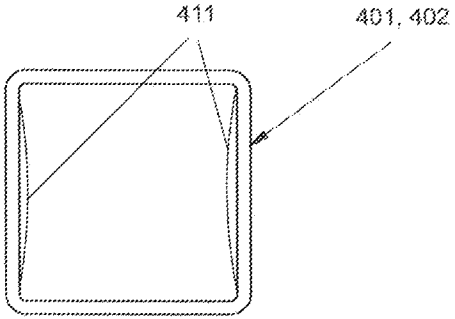
FIG. 11 is a cross-sectional view of a compressible element.
Figure 12A:
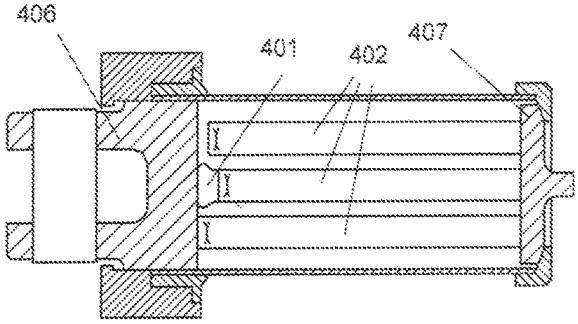
FIGS. 12*a*-12*f* are axial sections showing the embodiment of FIGS. 9-11 in an energy dissipation sequence from onset of impact (FIG. 12*a*) to shear-off (FIG. 12*f*)
Figure 12B:
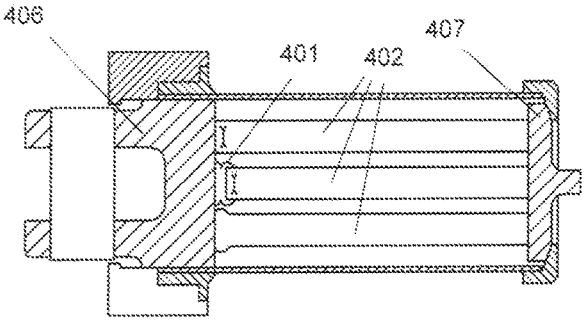
Figure 12C:
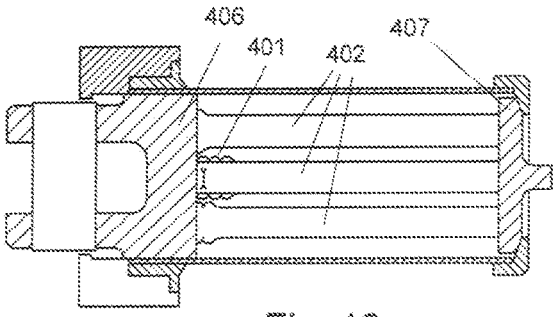
Figure 12D:
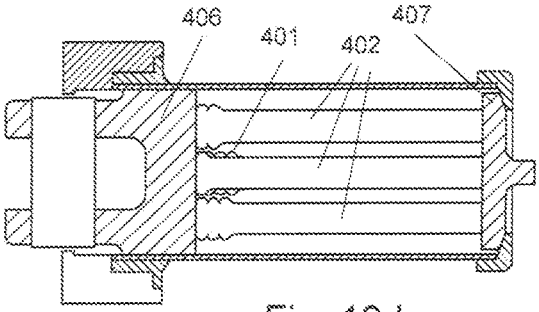
Figure 12E:
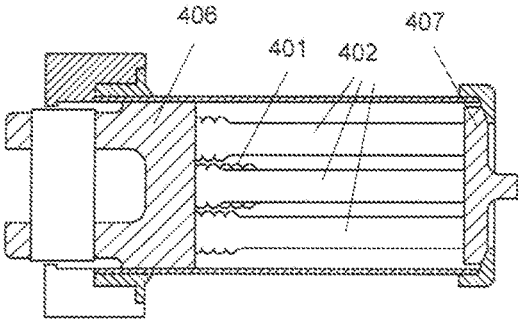
Figure 12F:
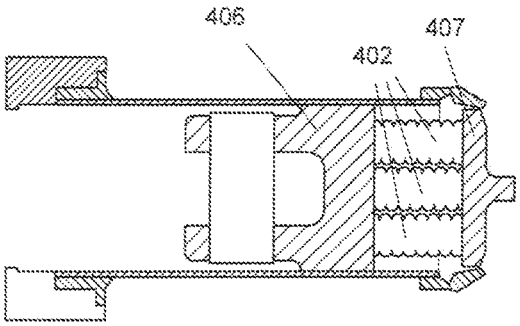

The operational characteristics of the embodiment of FIGS. 9 to 13 is illustrated in the force vs displacement/time diagram of FIG. 13. FIG. 13 is a graphic plot generated in load tests performed on a laboratory setup including 5 pcs of four-sided tubes of high-strength steel as the compressible elements, one of which is pre-tensioned in assembly. In FIG. 13, the vertical axis indicates force absorbed by the set of tubes whereas the horizontal axis illustrates the displacement (length of compression), or lapse of time from point of impact. The axes are dimensionless, the diagram nevertheless illustrating the true operational characteristics of this embodiment.

The tubes employed in the test are quadrangular in cross section, all sides of the cross section equal at 36 mm in length (tube width) and having a wall thickness of about 2 mm. The tube lengths are ranging from 200 mm to 188 mm, the tube lengths gradually reducing by 3 mm (each tube 3 mm shorter in length than the previous one). Triggers for a controlled deformation were applied as indentations 411 on two mutually opposite sides of the tubes. The indentations were 1 mm in depth, 20 mm in length and oriented transversely to the tube length at about 12 mm distance from the end of the tube. The indentations were produced using a punch and a punch pad.

The longest tube was set in pre-tension by a hydraulic press, whereas the rest four tubes were provided as non-pretensioned non-biased elements arranged in parallel with the pre-tensioned element. Impacts were simulated by an instant release of 550 kN and 1000 kN respectively to the sets of tubes.

In FIG. 13 it can readily be observed that the maximum load is reached through a number of overlapping peaks as the separate tubes are successively employed in absorption of the impact force. The displacement to maximum load is 12 mm in this test, as determined by the gradual tube length reduction of 3 mm in a set of five tubes. Maximum load was reached within approximately 0.005 sec.

To be further noted in FIG. 13 is the constant level and continuity or flatness of the curve that illustrates the load absorbed after reaching the load maximum. By incrementally displacing the compression of non-biased elements as provided for in this embodiment, the buckling of the compressible elements 401, 402 is shifted in phase and synchronized, such that one or some of the compressible elements provide their maximum resistance to buckling when one or some of the other compressible elements provide less resistance to buckling. By this phase-shift, a comparatively high and above all continuous level of energy absorption can be maintained throughout the energy absorption process.

The length reduction may be the same and equal among all compressible elements 401, 402, however, this is not an absolute requisite since the compressible elements need not all be of equal dimension and material properties.

For example, the length reduction between compressible elements may be in the order of about 2-20 mm, or in the order of about 2-10 mm if appropriate, depending on overall size of the energy dissipation device. In one embodiment as illustrated, a preferred length reduction is in the order of about 2-5 mm. If appropriate, the lengths of the compressible elements may be determined with tolerances down to tenths of millimetres as one of available measures for fine-tuning of the phase shift in the energy absorption sequence. Other available measures are, e.g., choice of material and cross-sectional dimensions or shape of the compressible elements 401, 402.

However, since buckling of the compressible elements is also governed by tube dimension and choice of material, it is not possible to provide detailed specifications for any arbitrary implementation of the invention. As a rule of thumb, the difference in length between two successively employed compressible elements may be determined such that the shorter element begins compressing at substantially the same time that the longer element completes its first buckling sequence. Although the embodiment 400 of FIGS. 9-13 is illustrated and explained in connection with a pivot coupling, the same teachings can be applied, mutatis mutandis, in a drawbar and intermediate train coupling, or in other words, in automatic couplers or in semi-permanent couplers as well.

Figure 14:
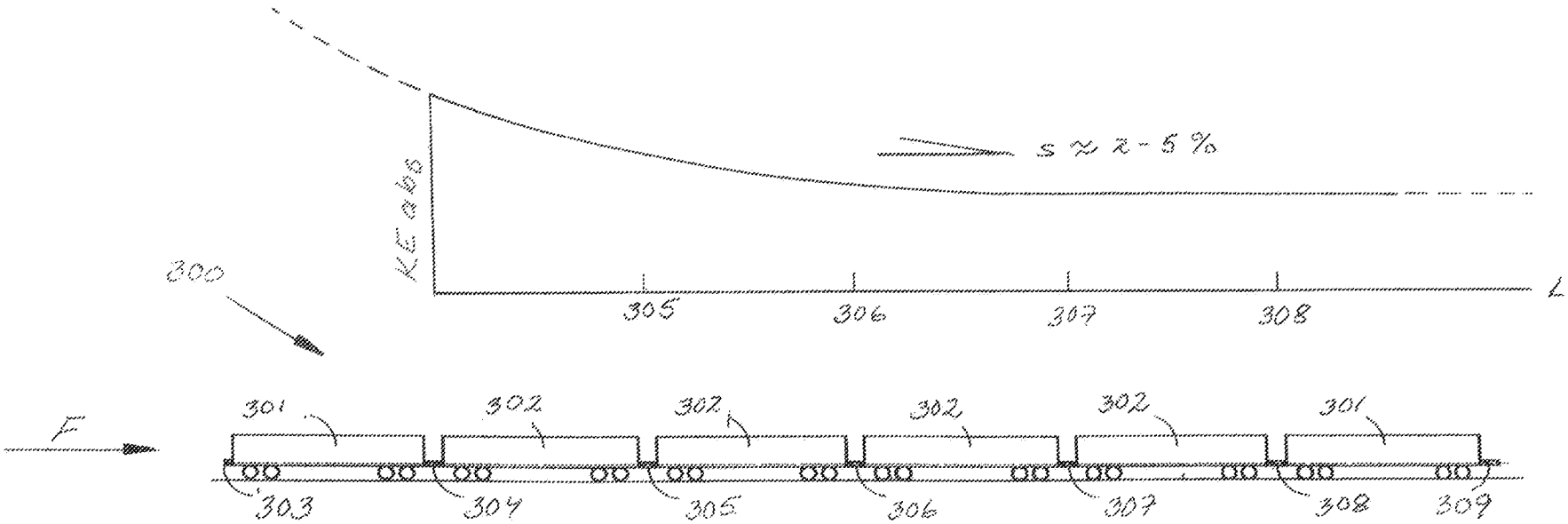
FIG. 14 illustrates a train set including a series of energy dissipation devices of the present invention in a train set, as well as a diagram representing the distribution of kinetic energy absorption throughout the series of energy dissipation devices.

FIG. 14 illustrates a train 300 of interconnected railroad units wherein each coupling interface between motorcars and trailing cars comprises energy dissipation devices 1, 100 or 400. In the train 300, the underframes of motorcars 301 and trailing cars 302 form axially rigid connecting members in a series of interconnected and interacting energy dissipation devices 1, 100, 400. At both ends of the series, front-end couplers 303 and rear-end couplers 309 may use one, two or all embodiments of the energy dissipation device 1, 100 or 400 as illustrated in FIG. 6. At intermediate connections, also the couplers at interfaces 304-308 may use one, two or all embodiments of the energy dissipation device 1, 100 or 400 as illustrated in FIG. 7.

In a case of collision and impact of sufficient magnitude being applied in the direction of F, a shock wave will translate from the front-end coupler 303 to the last intermediate coupler 308, involving the energy dissipation devices in the front-end coupler and in all intermediate couplers. Since the energy dissipation devices 1, 100 and 400 are pre-tensioned in assembly, and interconnected through the underframes of cars and motorcars, the entire series of energy dissipation devices will act unanimously, on impact performing substantially as one singular damper.

In order to remove any accidental slack in the connecting structures before peak loads are introduced in the intermediate devices, devices in the front-end coupler 303 and in the rear-end coupler 309 can be equipped and tuned for a gradually or stepwise increasing reaction to the impact force, as illustrated and explained with reference to FIG. 5. In result, the whole series of devices will react instantly and simultaneously to the peak load which is transferred to the first coupling interface as the first "triggering" stage is consumed in the energy dissipating device of the front-end coupler 303.

This strategy contributes to minimizing the impact damages at intermediate interfaces 304 to 308. If fully implemented throughout the train set as provisioned for in FIG. 6, FIG. 7 and in FIG. 14, the potential total length of axial compression or stroke length of all energy dissipation devices involved amounts to 5500 mm in the train set of FIG. 14 (six units). It is here assumed that the maximum compression length of the energy dissipation devices 1 or 400 is 300 mm before shear-off, and the maximum compression length of the energy dissipation devices 100 is 200 mm.

Thus, the accumulated stroke length and energy absorption capacity of devices 1, 100 and 400 operating in series provide the ability of distribution and absorption of a comparatively large amount of kinetic energy throughout the train set.

According to the invention, a higher amount of the potential stroke length in dampers is made available throughout the train. The solution involves the provision of at least one energy dissipation device, at each coupling interface in a train, which has a primary deformation zone of less compression strength than the compression strengths provided by a secondary or a third, or more if appropriate, deformation zones of the same device.

A technical result from this is that absorption of kinetic energy from a collision occurs for an extended time sequence and under a more completely utilized stroke length at each coupling interface.

The operational characteristics of the series of devices 1, 100, 400 is illustrated by the gradually levelling curve in the diagram of FIG. 14, which results from computations assuming train units 301, 302 of equal length.

The horizontal axis represents the distance L from the point of impact, whereas the vertical axis KEabs represents the amount of kinetic energy absorbed in percentage of the potential capacity of devices at interfaces 304 to 308. That is, the curve represents the relation between devices at the second, third, fourth etc. interfaces of the train, in terms of employed amount of potential stroke length and potential energy absorption. The curve is thus not related to the nominal kinetic energy that is translated through the series of devices, but is valid for all levels of energy within the operative limits of the devices at interfaces 304-308. Hence, the vertical axis is dimensionless. Also, the diagram starts at the first interface 304, while it is also assumed that the energy absorption capacity of devices in the front-end coupler, in most cases, will be exhausted upon impact (front collision).

From the diagram of FIG. 14 it will be noted, that onwards from the second interface 305, connecting cars number two and three, the curve levels out to assume an almost horizontal projection. Modelling shows that a slope S of about 2-5 percent between the second and fifth interfaces 305 and 308 can be achieved by equipping the energy dissipation devices accordingly. Expressed in other way, a chord length between the second and fifth interfaces on the levelling portion of the curve has a slope angle of about 1.8° to about 4.5° with respect to the horizon. Further optimization of the devices may result in an even flatter curve over the subject series of devices. On the other hand, in train sets of random composition, the slope of the curve over the second to fifth coupling interfaces may be somewhat steeper while still utilizing the benefits of a high degree of employment of available stroke length and distribution of kinetic energy throughout the series of devices, as provided for by the impact management strategy of the present invention. In this connection it will be realized that a slope S in the region of about 2% to about 5% between the second and fifth interfaces is clearly achievable and, within this region, is an improvement above the prior art.

Among the advantages achieved, for example, is that the crash protection system as disclosed provides the possibility of designing the first two interfaces after point of collision for absorption of less energy whereas the third to sixth interfaces, e.g., being designed for absorption of comparatively more energy. It enables "softening" of the energy absorption performance for the interfaces near the collision and transferring part of the energy absorption to the interfaces that are further away from the collision, without compromising the position of the complete energy absorption, and keeping the crash peak/wave/acceleration to a minimum.

The crash protection system of the present invention provides increased safety in a compact design: smaller diameters and shorter housing lengths are made possible, e.g. This is an advantage also for the railway car manufacturer. The system further provides improved condition monitoring, sustainable and efficient repair and upgrade. Housings and tubes can be re-used after impact. Other advantages are traceability and identification of steel used in deforming elements and housings. Production of the energy absorbing steel elements can be automated in roll-forming and laser beam continuous-welding processes, e.g. In all, the invention results in a more efficient utilization of specific energy per kilogram (kJ/kg) in the energy dissipation devices.

The invention claimed is:

1. An energy dissipation device for a train coupler adapted for absorbing kinetic energy from a collision, the energy dissipation device comprising:

a cylindrical housing, in one end having coupling means for coupling the housing in fixed relation to a train coupler;

at least one axially compressible, irreversibly deforming element of steel in the housing, the at least one axially compressible, irreversibly deforming element(s) extended in coaxial relation with the housing from said one end towards a second end of the housing; and a compression means retractable into the housing via said one end or said second end of the housing;

wherein the at least one axially compressible, irreversibly deforming element is pre-tensioned axially between said retractable compression means and a counter pressure means stationary secured in the housing in an axially opposite relation to the retractable compression means in said one end or said second end of the housing, and wherein the retractable compression means has a circular periphery shaped for guidance in non-destructive sliding contact with an inside wall of the housing upon retraction and compression of the compressible, irreversibly deforming element, while preserving an integrity of the housing.

2. The energy dissipation device of claim 1, wherein said one end of the housing comprises coupling means arranged for coupling to a bracket for a pivot bearing, the pivot bearing retractable into the housing via said one end of the housing upon release from the bracket, and wherein a shear-off assembly, providing counter pressure in compression, is coupled to said second end of the housing.

3. The energy dissipation device of claim 2, wherein the shear-off assembly comprises a counter pressure disc of circular shape, a bevelled periphery on the counter pressure disc bearing against opposite faces of a number of yieldable individual tongues which are distributed circumferentially about an inner circumference of a ring that is connectable to the housing in surrounding relation with the counter pressure disc, the tongues depending at a slanting angle from the inner circumference of the ring towards a center axis of the ring.

4. An energy dissipation device for a train coupler adapted for absorbing kinetic energy from a collision, the energy dissipation device comprising:

a first telescoping member in the form of a tube of a first diameter, said tube in one end carrying coupling means for coupling the tube to a drawbar of a train coupler in coaxial alignment with a center axis of the drawbar, a second telescoping member in the form of a cylindrical housing of a second diameter which is larger than the first diameter, said housing in one end carrying coupling means for coupling the housing to a drawbar of a train coupler in coaxial alignment with the center axis of the drawbar, wherein a second end of the tube is inserted and arranged retractable into the housing via an opposite second end of the housing, and at least one axially compressible, irreversibly deforming element of steel in the housing, the at least one axially compressible, irreversibly deforming element extended in coaxial relation with the housing from said one end of the housing towards the second end of the housing, wherein the at least one axially compressible, irreversibly deforming element is pre-tensioned axially between the coupling means in said one end of the housing and a neck portion on a mounting flange, coupled to said second end of the housing, and wherein the retracting end of the tube carries a compression disc which has a circular periphery shaped for guidance in non-destructive, sliding contact with an inside wall of the housing upon retraction and compression of the at least one axially compressible, irreversibly deforming element, while preserving an integrity of the housing.

5. The energy dissipation device of claim 4, wherein an axial extension of the neck portion ends in a shoulder of radial extension providing support in axial direction for the compression disc which is carried in the retractable end of the tube.

6. The energy dissipation device of claim 4, wherein an axial extension of the neck portion has an inner radius forming a circumferential control surface for the tube to move in sliding contact with the control surface upon retraction into the housing.

7. The energy dissipation device of claim 4, comprising an anti-rotation means in the form of a locking body shaped for form-fitting engagement in a correspondingly shaped seat formed in a flange of a member connectable to the housing, wherein a heel on the locking body in locking position engages a recess that runs circumferentially about an exterior of the housing.

8. The energy dissipation device of claim 4, comprising at least one intermediately positioned partition disc having a circular periphery arranged in sliding contact with the inside wall of the housing, the at least one partition disc being clamped and axially fixated between at least one axially compressible, irreversibly deforming element of a first compression strength extended from said one end of the housing to the partition disc, and at least one axially compressible, irreversibly deforming element of a second compression strength extended from the partition disc towards said second end of the housing, but otherwise moving freely in the housing.

9. The energy dissipation device of claim 4, wherein the at least one axially compressible, irreversibly deforming element is a tube made of roll-formed sections of high-strength steel, fused-together to form a multi-cornered cross-sectional profile wherein a tube wall, in circumferential direction, is a repeating pattern of angularly adjoining side planes connected in at least twelve outwardly protruding corners and at least eight inwardly protruding corners.

10. The energy dissipation device of claim 4, further comprising at least one axially compressible non-biased element in the housing, the at least one axially compressible non-biased element extended in parallel with at least one axially compressible element that is axially pre-tensioned in the housing between a compression means and a counter pressure means arranged respectively in opposite first and second ends of the housing, wherein the at least one axially compressible non-biased element are is of shorter length than the pre-tensioned at least one axially compressible element axially pre-tensioned in the housing.

11. The energy dissipation device of claim 10, wherein the lengths of the at least one axially compressible non-biased elements are incrementally reducing such that each at least one axially compressible non-biased element is a few millimetres shorter than another axially compressible non-biased element in the energy dissipation device, wherein differences in lengths are in a range of: about 2-20 mm, about 2-10 mm, or about 2-5 mm.

12. The energy dissipation device of claim 11, wherein all length differences between axially compressible non-biased elements are equal.

13. The energy dissipation device of claim 10, wherein the at least one axially compressible non-biased element extends cantilevered from the counter pressure means.

14. The energy dissipation device of claim 4, comprising a stroke length indicator.

15. A series of energy dissipation devices according to claim 1 for integration at coupling interfaces between interconnected cars and motor cars or locomotives of a train, wherein for individual devices of the series, stroke length and/or compression strength is predetermined with regard to the positions of the individual devices in the series and with the object of minimizing peak loads applied in intermediate devices.

16. The series of energy dissipation devices of claim 15, wherein at each coupling interface between train units, at least one energy dissipation device has a primary deformation zone of less compression strength than compression strengths provided by successive deformation zones of the same device.

17. The series of energy dissipation devices according to claim 15, wherein the distribution and relative absorption of kinetic energy among the devices in the series can be graphically represented by a levelling curve which has a slope in the range of about 2% to about 5% from the second to the fifth coupling interfaces of the train.

18. The series of energy dissipation devices according to claim 15, wherein at least the foremost devices in the series are configured to provide a higher peak compression strength than any intermediate devices in the series.

19. The series of energy dissipation devices according to claim 15, wherein the foremost and aftmost devices in the series each has a primary deformation zone of less compression strength than the compression strengths provided by secondary or third deformation zones of the same devices.

20. A train coupler comprising an energy dissipation device according to claim 1.

* * * * *